US006825429B2

(12) United States Patent
Dove et al.

(10) Patent No.: US 6,825,429 B2
(45) Date of Patent: Nov. 30, 2004

(54) HERMETIC SEAL AND CONTROLLED IMPEDANCE RF CONNECTIONS FOR A LIQUID METAL MICRO SWITCH

(75) Inventors: Lewis R. Dove, Monument, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 100 days.

(21) Appl. No.: 10/403,743

(22) Filed: Mar. 31, 2003

(65) Prior Publication Data

US 2004/0188234 A1 Sep. 30, 2004

(51) Int. Cl.[7] ..... H01H 9/04

(52) U.S. Cl. ..... 200/302.1; 200/181

(58) Field of Search ..... 200/302.1, 181–185, 200/192, 193, 263, 214, 233, 188, 221, 227, 228, 234, 61.47, DIG. 43; 335/57, 58, 78, 47; 219/201, 528, 543, 549

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Von Tomkewitsch et al. |
| 3,529,268 | A | 9/1970 | Rauterberg |
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |
| 4,336,570 | A | 6/1982 | Brower et al. |
| 4,419,650 | A | 12/1983 | John |
| 4,434,337 | A | 2/1984 | Becker |
| 4,475,033 | A | 10/1984 | Willemsen et al. |
| 4,505,539 | A | 3/1985 | Auracher et al. |
| 4,582,391 | A | 4/1986 | Legrand |
| 4,628,161 | A | 12/1986 | Thackrey |
| 4,652,710 | A | 3/1987 | Karnowsky et al. |
| 4,657,339 | A | 4/1987 | Fick |
| 4,742,263 | A | 5/1988 | Harnden, Jr. et al. |
| 4,786,130 | A | 11/1988 | Georgiou et al. |
| 4,797,519 | A | 1/1989 | Elenbaas |
| 4,804,932 | A | 2/1989 | Akanuma et al. |
| 4,988,157 | A | 1/1991 | Jackel et al. |
| 5,278,012 | A | 1/1994 | Yamanaka et al. |
| 5,415,026 | A | 5/1995 | Ford |
| 5,502,781 | A | 3/1996 | Li et al. |
| 5,644,676 | A | 7/1997 | Blomberg et al. |
| 5,675,310 | A | 10/1997 | Wojnarowski et al. |
| 5,677,823 | A | 10/1997 | Smith |
| 5,751,074 | A | 5/1998 | Prior et al. |
| 5,751,552 | A | 5/1998 | Scanlan et al. |

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | SHO47-21645 | 10/1972 |
| JP | 62-276838 | 12/1987 |
| JP | 93-294317 | 12/1988 |
| JP | 8-125487 | 5/1996 |
| JP | 9-161640 | 6/1997 |
| WO | WO99/46624 | 12/1999 |

OTHER PUBLICATIONS

TDB–Acc–No.: NB8406827, "Integral Power Resistors For Aluminum Substrate", IBM Technical Disclosure Bulletin, Jun. 1984, US, vol. 27, Issue No. 1B, p. 827.

Bhedwar, Homi C., et al. "Ceramic Multilayer Package Fabrication." Electronic Materials Handbook, Nov. 1989, PP 460–469, vol. 1 Packaging, Section 4: Packages.

Kim, Joonwon, et al. "A Micromechanical Switch With Electrostatically Driven Liquid–Metal Droplet." Sensors and Actuators, A: Physical v 9798, Apr. 1, 2002, 4 pages.

Simon, Jonathan, et al. "A Liquid–Filled Microrelay Wtih a Moving Mercury Microdrop." Journal of Microelectromechanical Systems, Sep. 1997, pp 208–216, vol. 6, No. 3.

(List continued on next page.)

*Primary Examiner*—Elvin Enad
*Assistant Examiner*—Lisa Klaus
(74) *Attorney, Agent, or Firm*—Edward L. Miller

(57) ABSTRACT

One or more LIMMS devices on a substrate, possibly having same-surface signal conductors, are hermetically sealed by either: (a) Enclosing each entire LIMMS device beneath a common or respective outer cover that is separate from the LIMMS device(s) and impervious to contaminants; or (b) Fabricating each LIMMS device such that its individual cover block (which is already a component of the LIMMS and is not a separate outer cover) can be hermetically sealed against the substrate. Each case must limit the effects of the hermetic seal upon impedances. In case (a) the substrate is covered with a layer of dielectric material matching the ribbon-like footprint of the perimeter of the separate outer cover. In case (b), the entire (solid) footprint of the LIMMS cover block on the substrate receives a layer of dielectric material, which may itself then be covered, save for near its perimeter, with suitable adhesive. In case (a) the outer cover may be soldered to the perimeter footprint. In case (b) the cover block may be soldered to dielectric layer. In another embodiment for cases (a) and (b) glass frit is used in place of solder. Disturbances to signal line impedance may be compensated by changes in signal conductor width. The layer of suitable dielectric material may be a thin sheet or gasket of previously patterned ceramic material, or it may be formed by the application of a thick film paste. Suitable thick film dielectric materials deposited as a paste and subsequently cured include the KQ 150 and KQ 115 thick film dielectrics from Heraeus and the 4141 A/D thick film compositions from DuPont.

18 Claims, 9 Drawing Sheets

U.S. PATENT DOCUMENTS 5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner

HERMETIC SEAL AND CONTROLLED IMPEDANCE RF CONNECTIONS FOR A LIQUID METAL MICRO SWITCH

BACKGROUND OF THE INVENTION

Recent developments have occurred in the field of very small switches having moving liquid metal-to-metal contacts and that are operated by an electrical impulse. That is, they are actually small latching relays that individually are SPST or SPDT, but which can be combined to form other switching topologies, such as DPDT. (Henceforth we shall, as is becoming customary, refer to such a switch as a Liquid Metal Micro Switch, or LIMMS.) With reference to FIGS. 1–4, we shall briefly sketch the general idea behind one class of these devices. Having done that, we shall advance to the topic that is most of interest to us, which is a technique for hermetically sealing such switches when they are fabricated on a substrate.

Refer now to FIG. 1A, which is a top sectional view of certain elements to be arranged within a cover block 1 of suitable material, such as glass. The cover block 1 has within it a closed-ended channel 7 in which there are two small movable distended droplets (12, 13) of a conductive liquid metal, such as mercury. The channel 7 is relatively small, and appears to the droplets of mercury to be a capillary, so that surface tension plays a large part in determining the behavior of the mercury. One of the droplets is long, and shorts across two adjacent electrical contacts extending into the channel, while the other droplet is short, touching only one electrical contact. There are also two cavities 5 and 6, within which are respective heaters 3 and 4, each of which is surrounded by a respective captive atmosphere (10, 11) of a suitable gas, such as $N_2$. Cavity 5 is coupled to the channel 7 by a small passage 8, opening into the channel 7 at a location about one third or one fourth the length of the channel from its end. A similar passage 9 likewise connects cavity 6 to the opposite end of the channel. The idea is that a temperature rise from one of the heaters causes the gas surrounding that heater to expand, which splits and moves a portion of the long mercury droplet, forcing the detached portion to join the short droplet. This forms a complementary physical configuration (or mirror image), with the large droplet now at the other end of the channel. This, in turn, toggles which two of the three electrical contacts are shorted together. After the change the heater is allowed to cool, but surface tension keeps the mercury droplets in their new places until the other heater heats up and drives a portion of the new long droplet back the other way. Since all this is quite small, it can all happen rather quickly; say, on the order of a millisecond, or less. The small size also lends itself for use amongst controlled impedance transmission line structures that are part of circuit assemblies that operate well into the microwave region.

To continue, then, refer now to FIG. 1B, which is a sectional side view of FIG. 1A, taken through the middle of the heaters 3 and 4. New elements in this view are the bottom substrate 2, which may be of a suitable ceramic material, such as that commonly used in the manufacturing of hybrid circuits having thin film, thick film or silicon die components. A layer 14 of sealing adhesive bonds the cover block 1 to the substrate 2, which also makes the cavities 5 and 6, passages 8 and 9, and the channel 7, each moderately gas tight (and also mercury proof, as well!). Layer 14 may be of a material called CYTOP (a registered trademark of Asahi Glass Co., and available from Bellex International Corp., of Wilmington, Del.). Also newly visible are vias 15–18 which, besides being gas tight, pass through the substrate 2 to afford electrical connections to the ends of the heaters 3 and 4. So, by applying a voltage between vias 15 and 16, heater 3 can be made to become very hot very quickly. That in turn, causes the region of gas 10 to expand through passage 8 and begin to force long mercury droplet 12 to separate, as is shown in FIG. 2. At this time, and also before heater 3 begins to heat, long mercury droplet 12 physically bridges and electrically connects contact vias 19 and 20, after the fashion shown in FIG. 1C. Contact via 21 is at this time in physical and electrical contact with the small mercury droplet 13, but because of the gap between droplets 12 and 13, is not electrically connected to via 20.

Refer now to FIG. 3A, and observe that the separation into two parts of what used to be long mercury droplet 12 has been accomplished by the heated gas 10, and that the right-hand portion (and major part of) the separated mercury has joined what used to be smaller droplet 13. Now droplet 13 is the larger droplet, and droplet 12 is the smaller. Referring to FIG. 3B, note that it is now contact vias 20 and 21 that are physically bridged by the mercury, and thus electrically connected to each other, while contact via 19 is now electrically isolated.

The LIMMS technique described above has a number of interesting characteristics, some of which we shall mention in passing. They make good latching relays, since surface tension holds the mercury droplets in place. They operate in all attitudes, and are reasonably resistant to shock. Their power consumption is modest, and they are small (less than a tenth of an inch on a side and perhaps only twenty or thirty thousandths of an inch high). They have decent isolation, are reasonably fast with minimal contact bounce. There are versions where a piezo-electrical element accomplishes the volume change, rather than a heated and expanding gas. There also exist certain refinements that are sometimes thought useful, such as bulges or constrictions in the channel or the passages. Those interested in such refinements are referred to the Patent literature, as there is ongoing work in those areas. See, for example, U.S. Pat. No. 6,323,447 B1.

To sum up our brief survey of the starting point in LIMMS technology that is presently of interest to us, refer now to FIG. 4. There is shown an exploded view of a slightly different arrangement of the parts, although the operation is just as described in connection with FIGS. 1-3. In particular, note that in this arrangement the heaters (3, 4) and their cavities (5, 6) are each on opposite sides of the channel 7. Another new element to note in FIG. 4 is the presence of contact electrodes 22, 23 and 24. These are (preferably thin film) depositions of metal that are electrically connected to the vias (19, 20 and 21, respectively). They not only serve to ensure good ohmic contact with the droplets of liquid metal, but they are also regions for the liquid metal to wet against, which provides some hysteresis in the pressures required to move the droplets. This is needed to guarantee that the contraction caused by the cooling of the heated (and expanded) operating medium does not suck the droplet back toward where it just came from. The droplets of liquid metal are not shown in the figure.

If contact electrodes 22–24 are to be produced by a thin film process, then they will most likely need to be fabricated after any thick film layers of dielectric material are deposited on the substrate (as will occur in connection with many of the remaining figures). This order of operations is necessitated if the thick film materials to be deposited need high firing temperatures to become cured; those temperatures can easily be higher than what can be withstood by a layer of thin film metal. Also, if the layer of thin film metal is to depart from the surface of the substrate and climb the sides of a channel, then it might be helpful if the transition were not too abrupt.

Some of the issues that surround the construction of a LIMMS device are a suitable hermetic seal and the control of electrical impedance for the signal lines served by the device. Hermetic construction is important, not so much because of the presence of mercury that needs to be sealed in to prevent its escape (the amounts involved are quite small and fly underneath regulatory radar, so to speak), as to assist in obtaining operational reliability by sealing out potential contaminants. For instance, a skin of oxidized mercury on the droplet can interfere with both mechanical motion and good electrical contact. Unfortunately, the CYTOP adhesive is slightly permeable to gases such as oxygen, and over a long period of time the mercury will develop an oxidized surface. The further issue of electrical impedance is important because LIMMS are sufficiently small that they lend themselves for use in high frequency applications where controlled impedance transmission lines are common. These might be strip lines or co-planar transmission lines.

One method of providing a hermetic seal for one or more LIMMS devices fabricated upon a substrate is to apply an outer cover over the LIMMS and any other nearby circuitry of interest. The outer cover itself may be of metal, ceramic or glass, and is impervious to contaminants, provides a high degree of mechanical protection, and if of metal, also offers potential electrical shielding. Metallic outer covers are typically soldered in place, which requires a ring of metal deposited on the substrate and matching the perimeter of the cover. This prevents any of the signal leads from traversing under the cover while on the same side of the substrate, and leads to the use of vias to get signals onto the other side of the substrate. Such use of vias might not be possible, or if it is, might not be convenient, either for reasons of cost or because of the detrimental effects of vias on controlled impedance RF conductors.

Glass and ceramic outer covers can be hermetically attached with glass frit, but the surface irregularities posed by same-surface signal lines can present potential difficulties, ranging from changes in surface height, issues of whether or not the surface of the signal line is readily wetted by frit, to imprecise electrical effects on the signal lines owing to uncontrolled variations in certain physical parameters. Attaching an outer cover directly to a substrate having top surface signal lines by using frit is not preferred, even though it might otherwise be desirable to use a glass or ceramic outer cover and attach it with frit.

In some applications it may be desirable to avoid the use of an outer cover plate, and leave the cover block of the LIMMS exposed. The use of CYTOP as an adhesive for the cover blocks is quite satisfactory, but it leaves something to be desired as a hermetic seal against the substrate. It is slightly permeable, and allows a slow oxidation of the mercury over the long term.

It would be desirable if there were a way to allow the use of a genuine hermetically sealed outer cover plate over the LIMMS devices without interfering with same-surface routing of signal traces to and from the LIMMS devices located beneath that outer cover plate, and to allow that hermetic seal without requiring the use of vias. Since one of the objections to the use of vias (aside from the possibility that the other surface might not be available for use!) is their ill effect on controlled impedance conductors, it follows that whatever technique allows an outer cover to cooperate with same-surface routing of signal conductors should likewise not produce undesirable impedance effects as those conductors pass under the perimeter of that outer cover. This remains so whether the outer cover plate is metallic and attached with solder or is non-metallic and attached with frit. It would also be desirable if, in instances where an outer cover plate is not desired or is inappropriate, there were still a good way to hermetically seal a LIMMS device cover block against the substrate while allowing the signal conductors to maintain same-surface routing and emerge from beneath the cover block without the use of vias. What to do?

SUMMARY OF THE INVENTION

A solution to the problem of obtaining an improved hermetic seal for one or more LIMMS devices on a substrate, and possibly having same-surface controlled impedance signal conductors on that substrate, is to either: (a) Enclose each entire LIMMS device beneath a common or respective outer cover that is separate from the LIMMS device(s), impervious to contaminants, and is hermetically sealed against the substrate; or (b) Fabricate each LIMMS device such that its individual cover block (which is already a component of the LIMMS and is not a separate outer cover or cover plate) can be hermetically sealed against the substrate. Each case must respect the presence of any same-surface signal conductors in the vicinity of the hermetic seal by limiting the effects of the hermetic seal upon impedances of those same-surface conductors.

In case (a) any same-surface conductors and the underlying substrate are covered with, or have affixed thereto, a layer of suitable dielectric material that is impermeable to contaminants and to the fluid and gas content of the LIMMS. That layer of dielectric material can essentially be the ribbon-like footprint of the perimeter of the separate outer cover, which may be recessed to accommodate the LIMMS device(s) it encloses. If there is to be no separate outer cover (case (b)), then the entire (solid) footprint of the LIMNS cover block on the substrate may receive a layer of the suitable and impermeable dielectric material deposited on or affixed to the substrate, which layer of such dielectric may itself then be covered, save for near its perimeter, with a layer of suitable adhesive. The perimeter footprint (in the case (a) of an outer cover) or the exposed perimeter (LIMMS cover block of case (b) and no outer cover) of the suitable and impermeable dielectric layer may be metalized. In case (a) the outer cover is soldered to the perimeter footprint (the outer cover may be metallic or if non-metallic, have a metalized region for receiving the solder). In case (b) a beveled edge of the cover block is also metalized, and the cover block is then soldered to the suitable dielectric layer subsequent to achieving adhesion with the layer of adhesive. In another embodiment for cases (a) and (b) glass frit is used in place of solder, and no metalized regions are required. In either of cases (a) and (b) the layer of suitable impermeable dielectric physically separates and insulates the various same-surface signal conductors from any conductive soldering.

This plan depends upon the use of a suitable dielectric material, which must be strong, adheres well to the substrate, is impervious to contaminants, is capable of being-patterned, and if also desired, which can be metalized for soldering. It should also have well controlled and suitable properties as a dielectric, so that would-be disturbances to signal line impedance can be consistently anticipated and appropriately compensated as those signal lines pass beneath structures presenting a change in capacitance (e.g., but not limited to, the conductive solder). Such compensation may include changes in signal conductor width in locations that pass beneath locations having solder. Given a choice, a lower dielectric constant (K) is preferable over a higher one. The layer of suitable dielectric material may be a thin sheet or gasket of previously patterned ceramic material, or it may be formed by the application of a thick film paste. Suitable thick film dielectric materials deposited as a paste and subsequently cured include the KQ 150 and KQ 115 thick film dielectrics from Heraeus and the 4141 A/D thick film compositions from DuPont.

DESCRIPTION OF A PREFERRED EMBODIMENT

Figure 5:
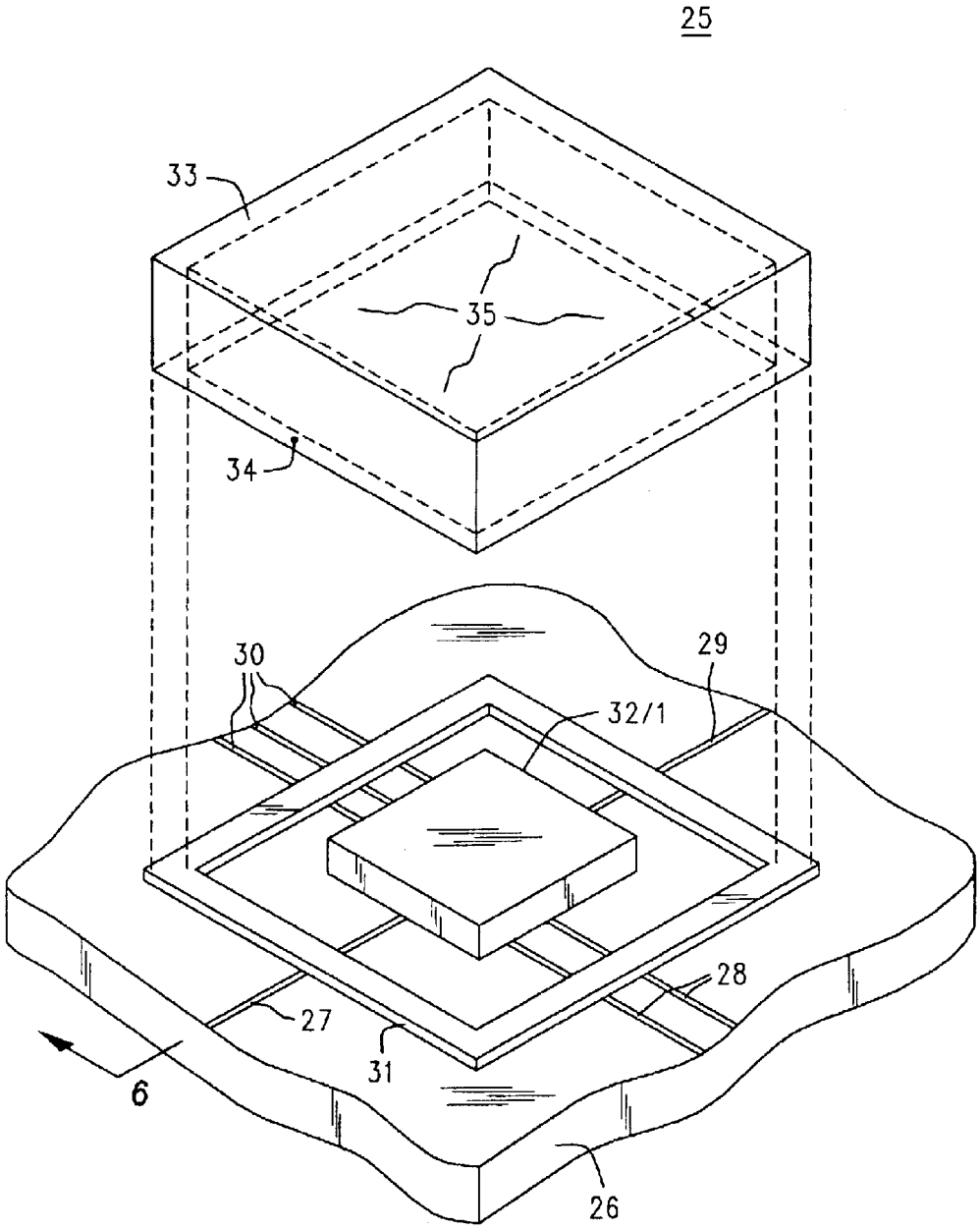
FIG. 5 is a simplified exploded view of a LIMMS device having same-surface signal conductors and that is hermetically sealed with a metallic, glass or ceramic outer cover plate.

Refer now to FIG. 5, wherein is shown a simplified representation 25 of a substrate 26 carrying thereon one or more LIMMS devices (32/1) having signal and control conductors (27–30) disposed on the same side, or surface of the substrate, as the LIMMS device. And although for simplicity the figure shows only one LIMMS device, it will be appreciated that: there might be several LIMMS devices; that there might also be other ancillary components or circuitry proximate the one or more LIMMS devices; and, that all such devices and components are to be part of the same hermetically sealed environment. The intent of this embodiment is to provide such a hermetically sealed environment with an outer cover 33 having a recessed cavity (35) therein that will enclose the parts to be hermetically sealed when a perimeter contact region 34 of the outer cover is brought into contact with the substrate and subsequently sealed.

Direct attachment of the outer cover 33 to the substrate 26 is generally not preferred when there are same-surface conductors (27–30) that would need to pass under the hermetic seal; there is a strong likelihood of creating in those conductors spurious impedances whose values cannot be reliably predicted from one instance to the next. We instead place an intervening region or layer of low dielectric constant (K) dielectric material between the surface of the substrate and its conductors one the on hand, and of the cover on the other. The added height of the intervening layer reduces coupling (the root cause of the reactive component of impedance) in its own right, and the low K scales down the magnitude of the unpredictable variations in coupling, so that the associated spurious impedance appears to be a smaller and more predictable quantity. (A 5% variation in something is a smaller absolute change in that something than a 30% variation.) A smaller amount of spurious impedance can be more readily compensated, or if small enough, might simply be safely ignored. Various embodiments will be described in addition to the one shown in FIG. 5, and part of the variations among them has to do with the nature of the region or layer of intervening dielectric material.

In one set of embodiments the intervening dielectric is formed from a thick film paste that is applied and subsequently cured. Examples of suitable thick film dielectric materials that may be deposited as a paste and subsequently cured include the KQ 150 and KQ 115 thick film dielectrics from Heraeus and the 4141 A/D thick film compositions from DuPont. These materials are primarily formulations of borosilicate glass containing small amounts of aluminum and magnesium. These products are applied as a paste, typically through a screen or stencil, and subsequently cured by the application of heat. They may be patterned at the time of application, before curing, or after curing by well known techniques (e.g., laser etching). These process are all described by the associated data sheets from the respective manufacturers. While the end result of using any of these products is essentially the same (a patterned region of controlled thickness and having a dielectric constant K of about 3.9) they have various ancillary differences that may be of interest to the designer. These include a change of color when cured, and an upward shift in softening temperature after an initial cure to facilitate structural stability during subsequent processing steps that require the re-application of heat to produce curing or processing of materials applied in those subsequent processing steps.

In another set of embodiments the region of intervening dielectric material can be a patterned sheet of thin ceramic that is first fabricated and then attached to where it is needed (as if it were a gasket).

Returning now to the particular embodiment shown in FIG. 5, a ring 31 of dielectric material is fabricated upon the substrate using thick film techniques, and is slightly larger than the "footprint" of the outer cover 33 (i.e., with the would-be region of contact of the cover's perimeter contact region 34 with the (upper) surface of the substrate). The footprint ring 31 of dielectric material may be fairly thin, say ten to twenty thousandths of an inch, but is thick enough to absorb and smooth out the surface irregularities formed by the various traces 27–30 as they pass under the footprint ring 31.

It will be appreciated that the footprint ring could also be formed ahead of time from a thin sheet of ceramic (i.e., is a ceramic gasket), and then affixed in place with an appropriately shaped layer of adhesive and hermetically sealed with its own hermetic seal. This arrangement is not expressly shown in this FIG (5) but is the general topic (that of ceramic gaskets) of a closely related embodiment shown in FIG. 10.

If the outer cover 33 is to be soldered on, then the footprint ring receives a layer of metal (which is not shown in FIG. 5, but which is shown as 43 in FIG. 6) to which the solder can wet. In this case the outer cover might be a conductive structure that may also act as a shield, and it may therefore be desirable that it be grounded. That may be achieved by arranging that the layer of metal 43 wrap over the edge of the footprint ring 31 and connect to a suitable ground present on the substrate. Such a connection could also be achieved by vias within the footprint ring itself. The conductive nature of a soldered outer cover (metal cover or metalized region of a non-metallic cover) raises the possibility that it presence will significantly disturb a controlled or nominal impedance, or produce a discontinuity in a characteristic impedance, for one or more of the conductors 27–30. However, even a non-soldered non-conductive outer cover can produce an undesirable disturbance. Such mischief can be mitigated in two ways.

First, the dielectric material used can be one whose properties are known, controlled to be stable from batch to batch, and that has a fairly low dielectric constant. A low dielectric constant produces less coupling than a high one, and batch to batch stability means that a selected compensatory strategy can be effective in a production setting.

Figure 7:
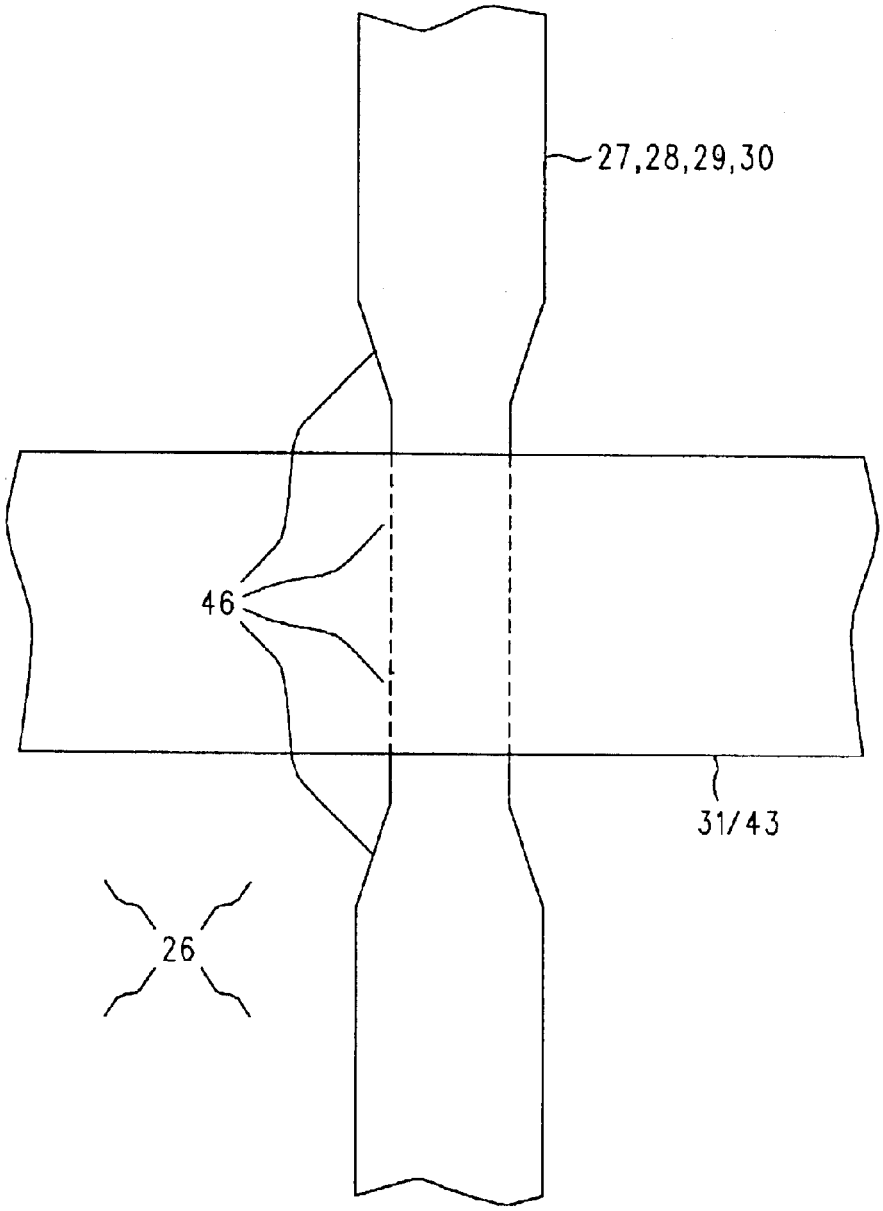
FIG. 7 is a simplified partial top view of one technique for compensating the impedance of a same-surface conductor of FIGS. 5 and 6 as it passes beneath the hermetic seal.

Second, in the event that the conductors 27–30 include one or more transmission lines that are not of the fully shielded variety (e.g., are strip lines or co-planar structures), then it may be desirable to alter the shape of the transmission line's center conductor in the vicinity of where it passes under the footprint ring/cover. This will be discussed in connection with FIG. 7. Such an alteration in shape can reduce coupling (less surface area for capacitance), and may also be a desirable thing to do for same-surface conductors that are not actual transmission lines.

Figure 6:
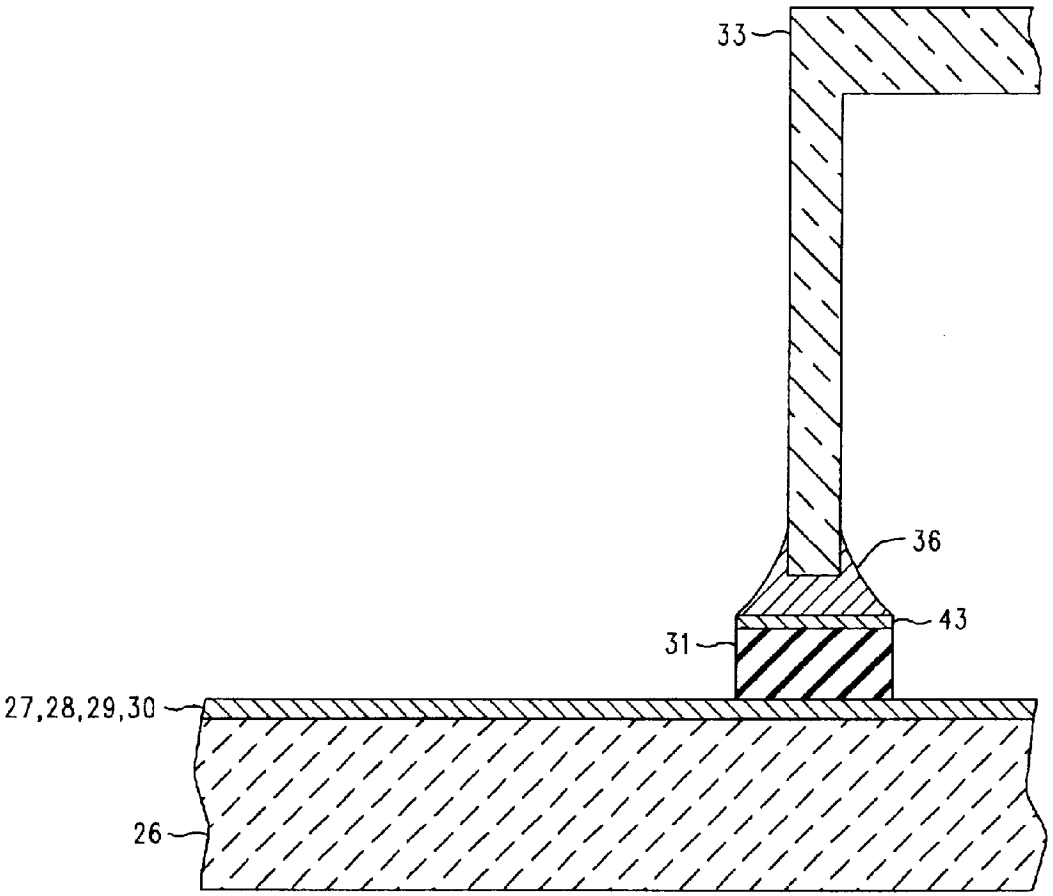
FIG. 6 is a simplified cross sectional view of the embodiment of FIG. 5 in the vicinity of where the outer cover plate is affixed to produce an improved hermetic seal.

Refer now to FIG. 6, wherein is shown a partial cross-sectional view of the arrangement 25 of FIG. 5. Note that a layer of metal 43 has been deposited on top of the footprint ring 31. This allows an outer cover 33 of suitable material to be soldered with solder 36 to the balance of the assembly (31/26, etc.). In another embodiment layer 43 is not needed, and material 36 would represent a glass frit that has been applied to an outer cover 33 of glass or ceramic material. In yet another embodiment the footprint ring 31 is a ceramic gasket adhered to the surface of the substrate by a corresponding layer of adhesive (CYTOP) and a separate associated hermetic seal. (That is, element 31 of FIG. 6 becomes replaced by the ceramic gasket 48, adhesive layer 47 and hermetic seal 50 of FIG. 10.)

Now consider an issue related to the presence of the outer cover 33 atop the footprint ring 31. There may well be an undesirable disturbance to the impedance of a signal line (27–29) as it passes under the footprint ring and the edge or lip of the cover. The basic reason for the disturbance is a capacitance from the signal line to the structure above it. The disturbance will be even greater if the outer cover is metallic or conductive layer 43 is present. In any event, the disturbance may be reduced or eliminated by suitably narrowing the trace for the signal lines as it approaches and then passes beneath the footprint ring 31, as shown in region 46 of FIG. 7.

Figure 1A:
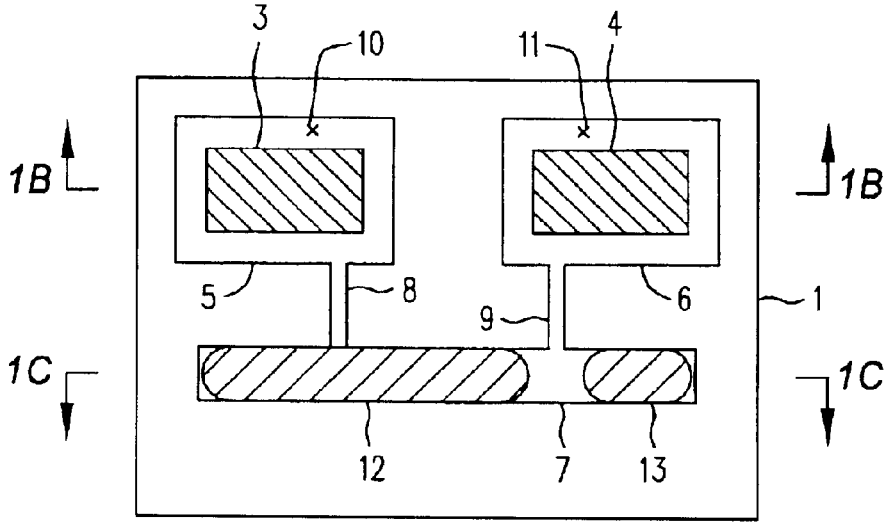
FIG. 1A PRIOR ART
FIGS. 1A–C are various sectional views of a prior art SPDT Liquid Metal Micro Switch (LIMMS), and wherein for convenience, while the heaters are shown as located on opposite ends of the channel, they are also shown as being on the same side thereof.
Figure 1B:
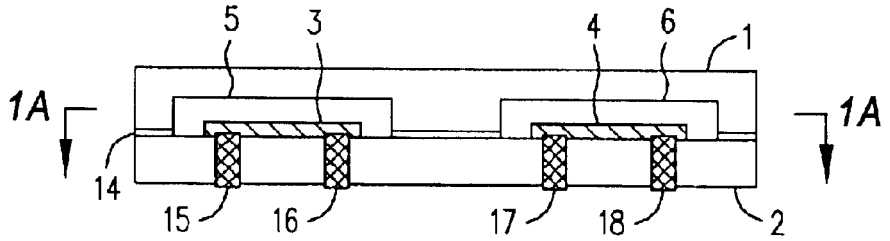
FIG. 1B PRIOR ART
Figure 1C:
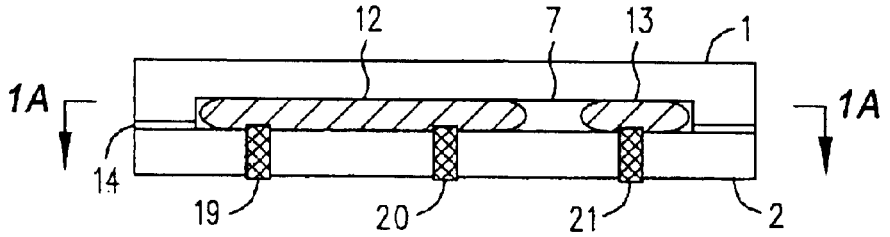
FIG. 1C PRIOR ART
Figure 2:
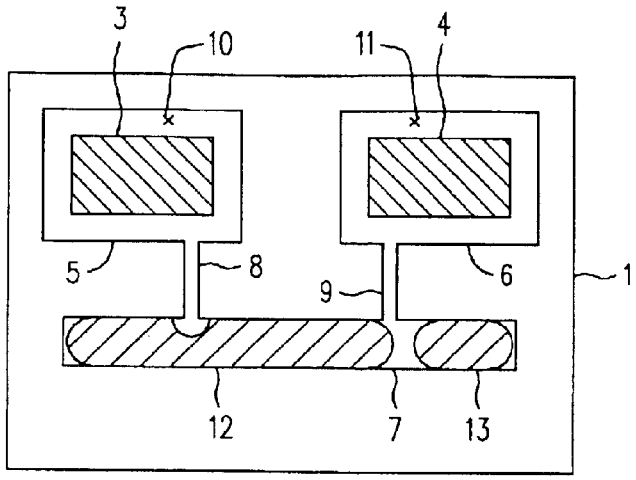
FIG. 2 PRIOR ART
FIG. 2 is a sectional view similar to that of FIG. 1A, at the start of an operational cycle.
Figure 3A:
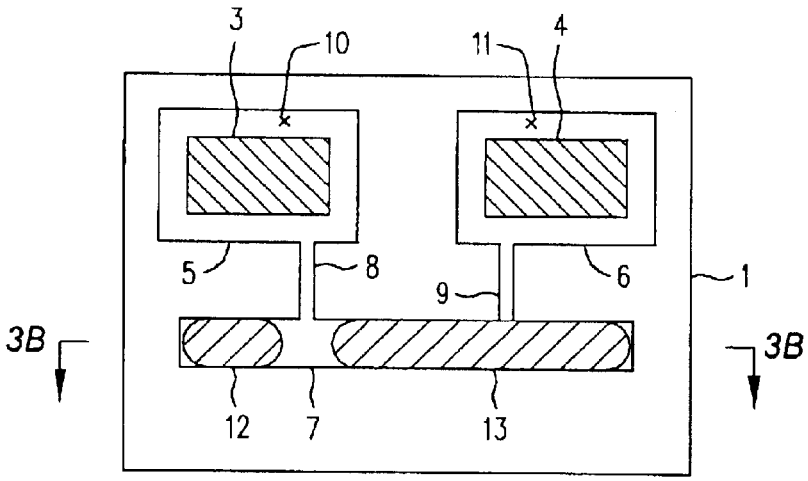
FIG. 3A PRIOR ART
FIGS. 3A–B are sectional view of the LIMMS of FIGS. 1A–C at the conclusion of the operation begun in FIG. 2.
Figure 3B:
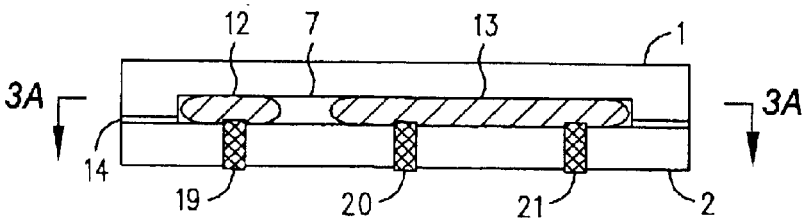
FIG. 3B PRIOR ART
Figure 4:
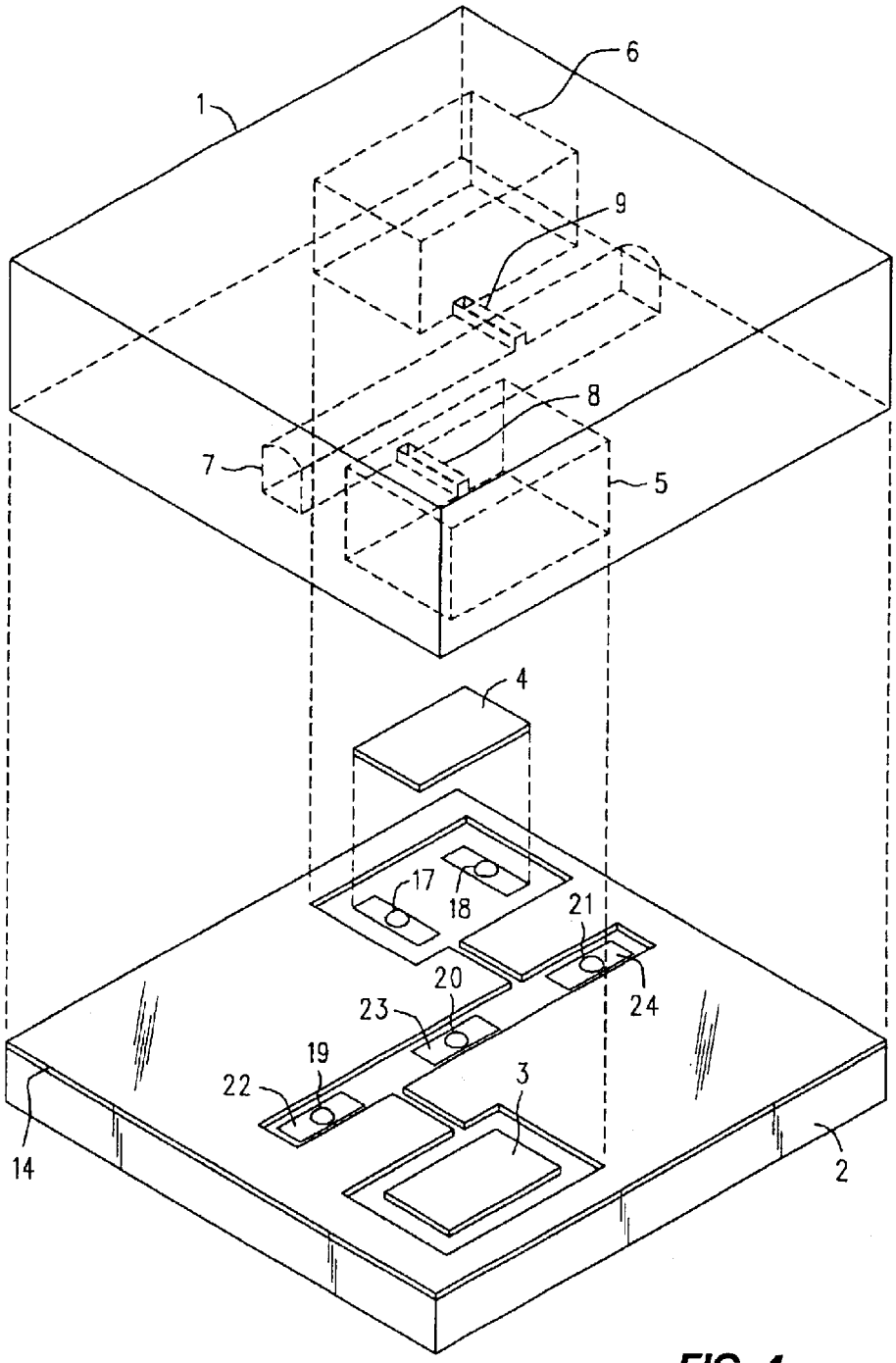
FIG. 4 PRIOR ART
FIG. 4 is an exploded view of a SPDT LIMMS similar to what is shown in FIGS. 1–3, but where the heaters are disposed both on opposite sides and on opposite ends of the channel.
Figure 8:
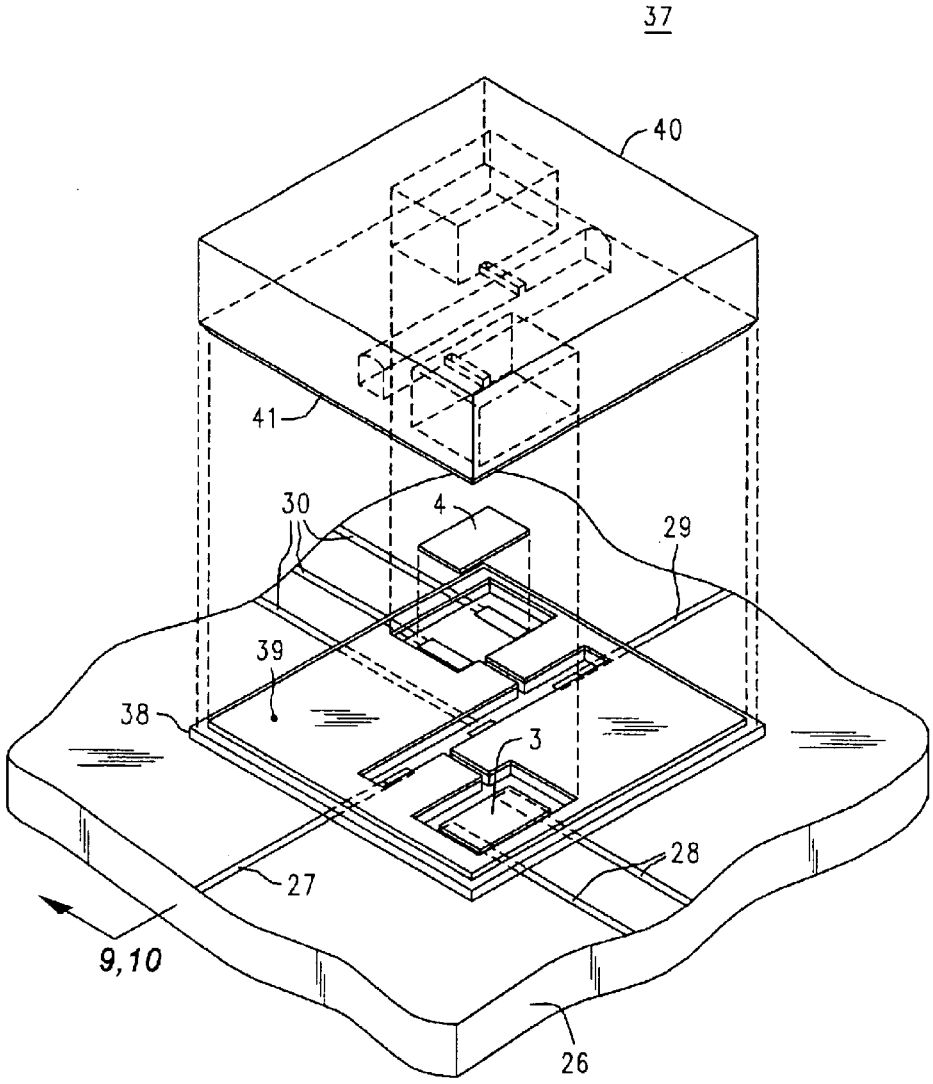
FIG. 8 is a simplified exploded view of a LIMMS device having same-surface signal conductors and whose cover block is to be hermetically sealed against the substrate in accordance with the invention.

We turn now to FIG. 8, which is a simplified exploded view 37 of an individual LIMMS device that is to be hermetic in its own right, and to be so without the use of an additional outer cover 33 such as is shown in FIGS. 4 or 5. This may be accomplished by first depositing a layer 38 of dielectric onto the substrate 26. The layer 38 is preferably at least as large as the footprint of the cover block 40, although "almost as large as" could conceivably be satisfactory. The cover block 40 may be of glass or ceramic. As before, the various same-surface signal conductors 27–30 for the LIMMS device are on the top surface of the substrate, which is the same side as receives the layer 38 of dielectric material. The layer 38 is, within the interior of the footprint, patterned to be absent in a way that corresponds to the internal cavities within the cover block 40. This would not absolutely have to be so, since there could be vias in the dielectric to allow connections between signal conductor 27–30 on the substrate and electrodes on the top of the layer 38 that connect to the heaters (3, 4) and to the moving mercury. This is not preferred, however, owing to the extra time and expense needed to form such vias, and because vias can have detrimental effects on controlled impedances. Moreover, a via is an extra component that has to function correctly, and thus adds complexity that can reduce reliability. Thus, for these reasons we prefer that the dielectric layer 38 be patterned to match the cavities within the cover block 40. The pattern can be produced by any suitable technique, including screen printing, and chemical and laser etching.

Ordinarily, it can be reasonably expected that the top surface of the layer 38 will be suitably flat after it is formed, but if not, then it may be lapped after curing to make it so. The thickness and viscosity of the uncured layer of dielectric is such that the surface height variations on the substrate produced by the various signal conductor 27–30 are significantly attenuated and smoothed out. In our experience, they can be ignored, particularly since there will be an intervening patterned layer 39 of CYTOP to serve as an adhesive gasket. The patterned layer 39 of CYTOP matches the pattern in the layer 38. Note that the layer 39 does not quite reach the edges of the layer 38 of dielectric. Note also that the edge 41 of the cover block 40 is a beveled edge. The beveled edge 41 and the perimeter of the layer 38 that is not covered by the CYTOP will be the location of the hermetic seal, as discussed now in connection with FIG. 9.

Figure 9:
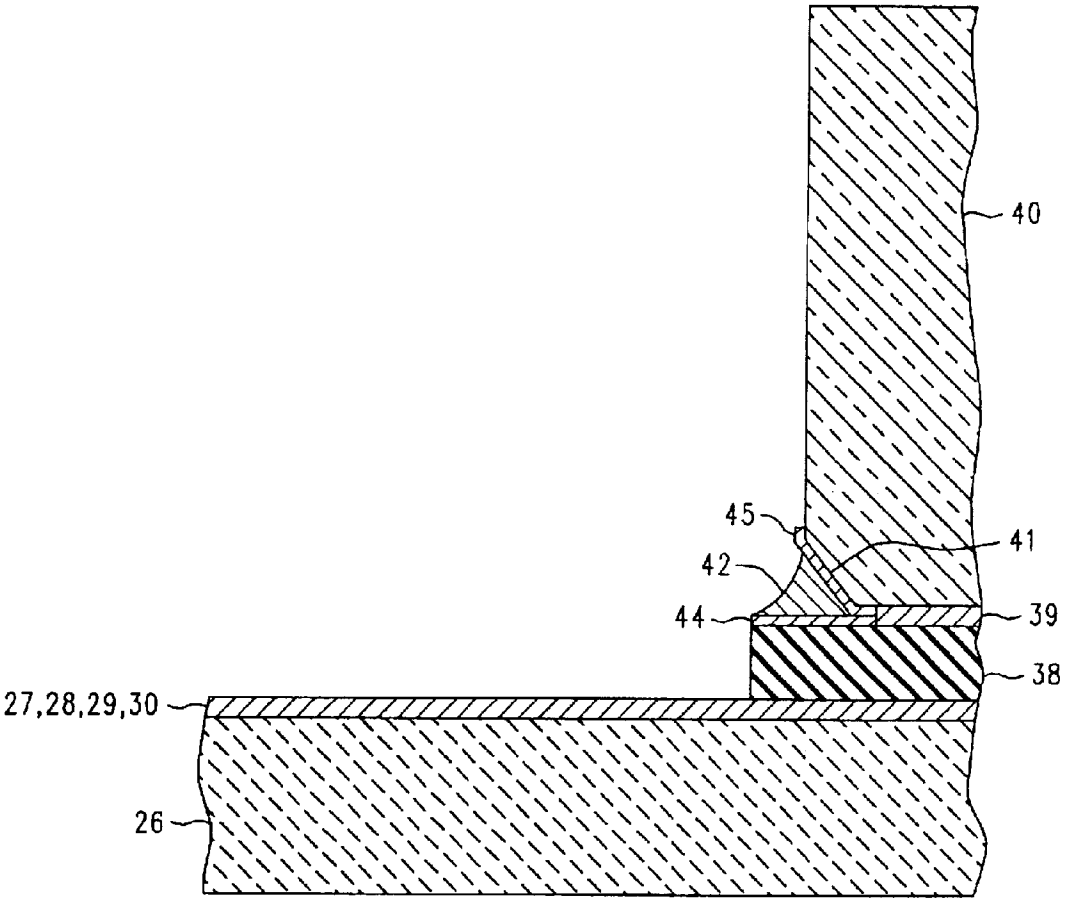
FIG. 9 is a simplified cross sectional view of the embodiment of FIG. 8 in the vicinity of where the perimeter of the cover block is affixed against an intervening layer of thick film dielectric to produce an improved hermetic seal.

Refer now to FIG. 9, wherein is shown a partial cross-sectional view of the arrangement 37 of FIG. 8. Note that the layer 39 of CYTOP does not extend all the way to the edge of the patterned layer 38 of dielectric. This is to allow a strip on the perimeter of the layer 38 to receive the material that forms the hermetic seal. With regard to the hermetic seal, there are various possibilities. Suppose that the sealing material is to be solder. In that case, we deposit a layer 44 of metal on the perimeter of the layer 38 of dielectric material, and another layer of metal 45 on the beveled edge 41 of the cover block 40. We have shown in the figure that the two layers 44 and 45 combine to equal the thickness of the layer 39 of CYTOP adhesive. This is actually a limiting case; more typically layers 44 and 45 would not combine to be nearly so thick. Metallic layers 44 and 45 are chosen to be solderable, and shown in the figure is a fillet of solder 42. Another possibility for the hermetic seal is that it is of glass frit. In that case the metallic layers 44 and 45 might be absent, and material 42 is a glass frit instead of solder. It is also probable that the edge of the cover block would not be beveled.

Figure 10:
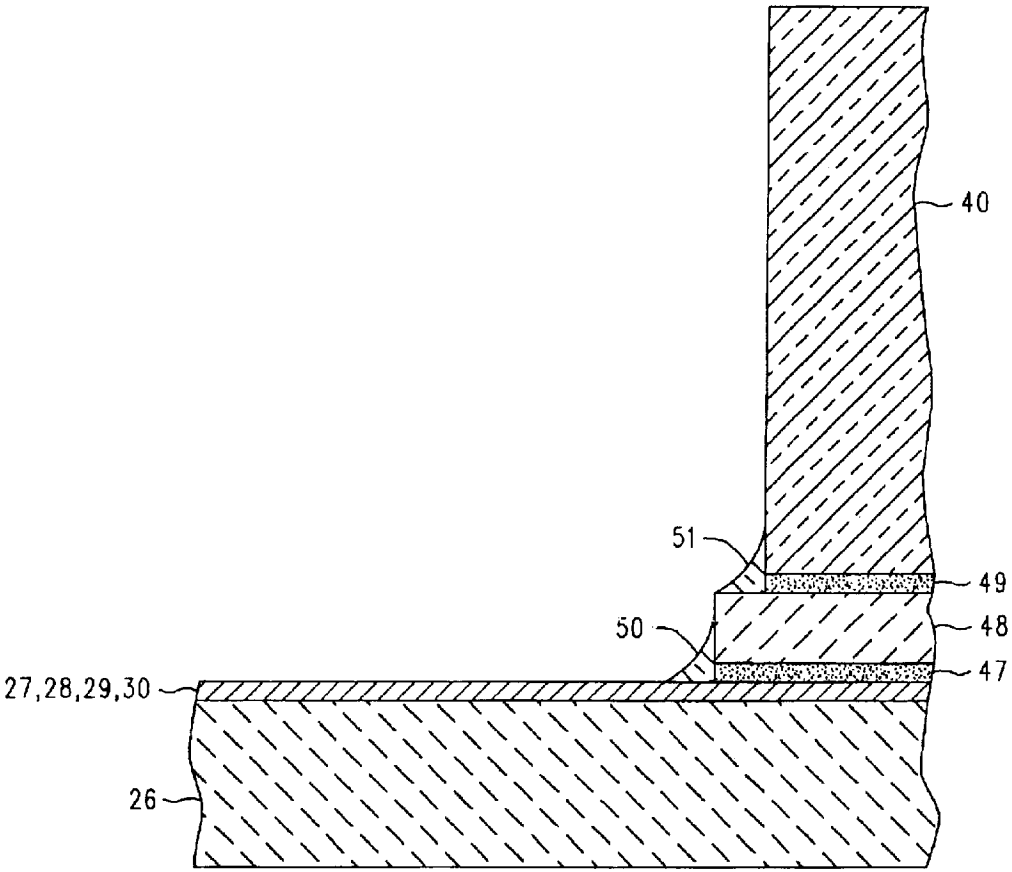
FIG. 10 is a simplified cross sectional view of the embodiment of FIG. 8 in the vicinity of where the perimeter of the cover block is affixed against an intervening ceramic gasket to produce an improved hermetic seal, and the ceramic gasket is itself hermetically sealed to the substrate.

Finally, refer now to FIGS. 8 and 10. In another embodiment dielectric layer 38 of FIG. 8 is replaced with a thin sheet of ceramic material (48 in FIG. 10) that has been suitably patterned, say, by cutting with a laser. FIG. 10 is a partial cross-sectional view similar to FIG. 9, but where the thick film layer 38 of FIG. 8 has been replaced with a thin ceramic gasket 48. Clearly, that gasket 48 will need hermetic sealing to the substrate: it can either have its own (preferred) or share a common seal that is effective for both the gasket 48 and the cover 40. However, whereas the cured thick film material (38) adheres directly to the surface of the substrate, the separate ceramic gasket 48 would too easily slide around on the surface of the substrate while such hermetic sealing was being accomplished. To prevent this and generally aid in the ease of assembly and moderate stresses arising from the non-uniform contact between the various surfaces (remember the same-surface conductors 27–30), a patterned layer 47 of adhesive (which may be CYTOP) is first applied to the substrate, followed by the ceramic gasket 48. At this point the top surface of the ceramic gasket 48 is available to serve the same function as the top surface of the (cured) thick film dielectric layer 38 of FIG. 8. Thus, we see in FIG. 10 another layer 49 of adhesive (more CYTOP) that corresponds to adhesive layer 39 of FIG. 9. Adhesive layer 49 serves to keep the cover 40 in place until the hermetic sealing is accomplished.

A further difference between FIGS. 9 and 10 illustrates different embodiments of the invention. In FIG. 10 the hermetic sealing is of glass frit. Note that there are two such seals, 50 and 51. It is possible that there might be simply one larger seal that performs the function of the two, but owing to the combined thickness of adhesive layers 47 and 49 with that of gasket 48, some frit materials might present difficulties in forming a sufficiently large fillet. With glass frit the difficulties begin to appear for heights above ten or twenty thousandths of an inch. Hence, we prefer two separate fillets (50 and 51) but that still may be applied at the same time and then fired at the same time. Another difference is visible between FIGS. 9 and 10. Note also that there are no beveled edges, and no metalized layers, in the embodiment of FIG. 10.

We claim:

1. An electronic assembly comprising:

a substrate having a first surface;

a layer of dielectric material having first and second surfaces whose shapes generally match that of a mounting footprint of a device to be mounted on the substrate, the first surface of the layer of dielectric material adhering to the first surface of the substrate at a location thereof where the device is to be mounted;

a LIMMS device mounted on the substrate and having a mounting surface adhering to the second surface of the layer of dielectric material; and a fillet of hermetic sealing material disposed against both a perimeter of the mounting surface of the LIMMS device and a region of the second surface of the dielectric layer proximate the perimeter of the mounting surface of the LIMMS device.

2. An electronic assembly as in claim 1 further comprising at least one conductor that adheres to the first surface of the substrate and that passes under the layer of dielectric material.

3. An electronic assembly as in claim 1 further comprising respective layers of metal deposited on the perimeter of the mounting surface of the LIMMS device and on the region of the second surface of the dielectric layer proximate the perimeter of the mounting surface of the LIMMS device and wherein the fillet of hermetic sealing material is of solder.

4. An electronic assembly as in claim 3 wherein the width of the at least one conductor is altered within a location proximate where it passes under the fillet of hermetic sealing material.

5. An electronic assembly as in claim 1 wherein the fillet of hermetic sealing material is of glass frit.

6. An electronic assembly as in claim 1 wherein the LIMMS device includes a cover block having in the mounting surface of the LIMMS device internal recesses that form channels therein and wherein the layer of dielectric material is of borosilicate glass.

7. An electronic assembly as in claim 6 wherein the borosilicate glass is applied according to thick film techniques.

8. An electronic assembly as in claim 7 wherein the borosilicate glass is patterned to match the channels in the mounting surface of the LIMMS device.

9. An electronic assembly as in claim 1 wherein the LIMMS device includes a cover block having in the mounting surface of the LIMMS device internal recesses that form channels therein and wherein the layer of dielectric material further comprises a ceramic gasket patterned to match the channels in the mounting surface of the LIMMS device and a matching patterned layer of adhesive material disposed between the ceramic gasket and the first surface of the substrate.

10. An electronic assembly as in claim 9 wherein the ceramic gasket is hermetically sealed to the first surface of the substrate by an additional hermetic seal.

11. An electronic assembly comprising:

a substrate having a first surface;

a LIMMS device mounted on the substrate;

an outer cover having a recess therein for enclosing the LIMMS device and also having a mounting perimeter surface;

a ribbon of dielectric material having first and second surfaces whose shapes generally match that of the mounting perimeter surface of the outer cover, the first surface of the ribbon dielectric material adhering to the first surface of the substrate at a location thereof that both surrounds the LIMMS device and that encompasses where the outer cover is to enclose the LIMMS device;

a fillet of hermetic sealing material disposed against both the mounting perimeter surface of the outer cover and a region of the second surface of the ribbon of dielectric material proximate the mounting perimeter surface of the outer cover.

12. An electronic assembly as in claim 11 further comprising at least one conductor that adheres to the first surface of the substrate and that passes under the ribbon of dielectric material.

13. An electronic assembly as in claim 12 wherein the width of the at least one conductor is altered within a location proximate where it passes under the ribbon of dielectric material.

14. An electronic assembly as in claim 11 wherein the second surface of the ribbon of dielectric material includes a layer of metal and further wherein the fillet of hermetic sealing material is solder.

15. An electronic assembly as in claim 11 the fillet of hermetic sealing material is a glass frit.

16. An electronic assembly as in claim 11 wherein the ribbon of dielectric material is of borosilicate glass.

17. An electronic assembly as in claim 16 wherein the borosilicate glass is applied according to thick film techniques.

18. An electronic assembly as in claim 11 wherein the ribbon of dielectric is a ceramic gasket and wherein the electronic assembly further comprises a layer of adhesive attaching the ceramic gasket to the first surface of the surface of the substrate and an additional fillet of hermetic sealing material disposed against both the ceramic gasket and the first surface of the substrate.

* * * * *